US010718085B2

(12) United States Patent
Huang et al.

(10) Patent No.: US 10,718,085 B2
(45) Date of Patent: Jul. 21, 2020

(54) COLOR MODIFICATION OF TEXTILE

(71) Applicant: Novozymes A/S, Bagsvaerd (DK)

(72) Inventors: Wenqi Huang, Beijing (CN); Yucheng Zhou, Beijing (CN); Yanli Huang, Beijing (CN)

(73) Assignee: Novozymes A/S, Bagsvaerd (DK)

( * ) Notice: Subject to any disclaimer, the term of this patent is extended or adjusted under 35 U.S.C. 154(b) by 0 days.

(21) Appl. No.: 15/309,244

(22) PCT Filed: May 15, 2015

(86) PCT No.: PCT/CN2015/079106
§ 371 (c)(1),
(2) Date: Nov. 7, 2016

(87) PCT Pub. No.: WO2015/172743
PCT Pub. Date: Nov. 19, 2015

(65) Prior Publication Data

US 2017/0073882 A1 Mar. 16, 2017

(30) Foreign Application Priority Data

May 15, 2014 (WO) ..... PCT/CN2014/077575

(51) Int. Cl.

| | |
|---|---|
| ***D06L 4/40*** | (2017.01) |
| ***D06P 5/15*** | (2006.01) |
| ***D06P 7/00*** | (2006.01) |
| ***D06P 5/02*** | (2006.01) |
| ***D06P 5/13*** | (2006.01) |

(52) U.S. Cl.
CPC ..... *D06L 4/40* (2017.01); *D06P 5/02* (2013.01); *D06P 5/137* (2013.01); *D06P 5/158* (2013.01); *D06P 7/00* (2013.01)

(58) Field of Classification Search
CPC ..... D06L 3/11; D06L 4/40; D06P 5/02; D06P 5/137; D06P 5/158; D06P 7/00
USPC ..... 435/69.1, 91.1; 536/23.1, 23.2; 530/350
See application file for complete search history.

(56) References Cited

U.S. PATENT DOCUMENTS

| | | | | |
|---|---|---|---|---|
| 6,146,428 | A * | 11/2000 | Kalum | C11D 3/38636 435/263 |
| 6,162,260 | A * | 12/2000 | Liu | D06L 1/14 8/401 |
| 6,165,769 | A * | 12/2000 | Andersen | C12N 9/2465 435/183 |
| 8,062,877 | B2 * | 11/2011 | Xiao | A23F 3/10 435/183 |
| 2004/0010856 | A1 | 1/2004 | McDevitt | |

FOREIGN PATENT DOCUMENTS

| | | | |
|---|---|---|---|
| CN | 101215785 | A | 7/2008 |
| WO | 96/12852 | A1 | 5/1996 |
| WO | 1999027083 | A1 | 6/1999 |
| WO | 99/34054 | A1 | 7/1999 |
| WO | 99/51808 | A1 | 10/1999 |
| WO | 2006/002034 | A1 | 1/2006 |
| WO | 2011/025861 | A1 | 3/2011 |
| WO | 2012/089023 | A1 | 7/2012 |

OTHER PUBLICATIONS

Esteghlalian et al., Application of thermostable pectate lyase in bioscouring of cotton fabrics at laboratory and pilot scales. Industrial Application of Enzymes on Carbohydrate-Based Material, ACS Symposium Series; American Chemical Society, 2007, Chapter 9: 122-136. (Year: 2007).*

Etters J.N., Cotton preparation with alkaline pectinase: an environmental advance. Textile Chemist and Colorist & American Dyestuff Reporter, www.aatcc.org. Nov. 1999, vol. 1(3): 33-36. (Year: 1999).*

* cited by examiner

*Primary Examiner* — Ganapathirama Raghu
(74) *Attorney, Agent, or Firm* — Kristin McNamara

(57) ABSTRACT

A method for treating dyed textile, comprises contacting the dyed textile with a pectolytic enxyme, wherein the said method is not applied during the abrasion stage when the dyed textile is a denim fabric.

12 Claims, No Drawings

Specification includes a Sequence Listing.

COLOR MODIFICATION OF TEXTILE

CROSS-REFERENCE TO RELATED APPLICATIONS

This application is a 35 U.S.C. 371 national application of international application no. PCT/CN2015/079106 filed May 15, 2015, which claims priority or the benefit under 35 U.S.C. 119 of international application no. PCT/CN2014/077575 filed May 15, 2014. The content of these applications is fully incorporated herein by reference.

REFERENCE TO A SEQUENCE LISTING

This application contains a Sequence Listing in computer readable form, which is incorporated herein by reference.

FIELD OF THE INVENTION

The present invention relates to a method for treating dyed textile with a pectolytic enzyme.

BACKGROUND OF THE INVENTION

The use of enzymes to treat textiles is now well established. Amylases are used for desizing, and cellulases are used for abrading. Enzymatic such as laccases, peroxidase or perhydrolase have also been applied in textile processing for color modification, in place of harsh chemical bleaching treatment.

WO96/12852 discloses a process for providing a bleached look in the colour density of the surface of dyed fabric, comprising contacting, in an aqueous medium, a dyed fabric with a phenol oxidizing enzyme system, such as a laccase together with oxygen, and an enhancing agent (mediator).

WO99/34054 discloses a process for removal of excess dye from dyed fabric with a rinse liquor comprising at least one peroxidise, an oxidase agent and at least one mediator, such as liquor comprising a peroxidase, hydrogen peroxidise and a mediator like 1-hydroxy-benzotriazole.

WO2011/025861 discloses compositions and methods for the enzymatic abrading and color modification of dyed textiles with perhydrolases.

There remains a need in textile industry to modify textile color by other solution.

SUMMARY OF THE INVENTION

The present invention relates to a method for treating dyed textile, comprising contacting dyed textile with a pectolytic enzyme.

In some embodiments, the dyed textile is dyed fabric or dyed garment.

In some embodiments, the color of the dyed textile is modified after the said treating process. In some preferable embodiments, the color modification is preferably selected from strengthening of color, lightening of color, change of color and change in color cast.

In some embodiments, the method is applied before, during or after any stages of fabric washing stage, such as desizing stage, abrasion stage and conventional color modification stage, it also can be applied in any combined washing stages.

In some embodiments, the method is not applied during the denim abrasion stage.

In the present invention, the pectolytic enzyme is preferably selected from the group consisting of pectin lyases (EC 4.2.2.10), galactanases (EC 3.2.1.89), arabinanases (EC 3.2.1.99), pectin esterases (EC 3.1.1.11), mannanases (EC 3.2.1.78), polygalacturonases (EC 3.2.1.15) and pectate lyases (EC 4.2.2.2).

In some embodiments, the dyed textile is denim fabric. In some embodiments, the dye is indigo dye, sulfur dye and/or reactive dye.

The present invention also relates to a composition, comprising a pectolytic enzyme, a peroxidase, an amylase and/or a cellulase.

DETAILED DESCRIPTION OF THE INVENTION

As used herein, the singular forms "a", "an", and "the" include plural references unless the context clearly dictates otherwise. Thus, for example, references to "a pectolytic enzyme" include the use of one or more pectolytic enzyme. "A step" of a method means at least one step, and it could be one, two, three, four, five or even more method steps.

Enzyme

EC-numbers may be used for classification of enzymes. Reference is made to the Recommendations of the Nomenclature Committee of the International Union of Biochemistry and Molecular Biology, Academic Press Inc., 1992.

It is to be understood that the term enzyme, as well as the various enzymes and enzyme classes mentioned herein, encompass wild-type enzymes, as well as any variant thereof that retains the activity in question. Such variants may be produced by recombinant techniques. The wild-type enzymes may also be produced by recombinant techniques, or by isolation and purification from the natural source.

In a particular embodiment the enzyme in question is well-defined, meaning that only one major enzyme component is present. This can be inferred e.g. by fractionation on an appropriate size-exclusion column. Such well-defined, or purified, or highly purified, enzyme can be obtained as is known in the art and/or described in publications relating to the specific enzyme in question.

Pectolytic Enzyme

The term "pectolytic enzyme" as denoted herein, is intended to include any pectinase enzyme defined according to the art where pectinases are a group of enzymes that hydrolyse glycosidic linkages of pectic substances mainly poly-1,4-a-D-galacturonide and its derivatives (see reference Sakai et al., Pectin, pectinase and propectinase: production, properties and applications, pp 213-294 in: Advances in Applied Microbiology vol: 39, 1993) which enzyme is understood to include a mature protein or a precursor form thereof or a functional fragment thereof which essentially has the activity of the full-length enzyme. Further-more, the term "pectolytic" enzyme is intended to include homologues or analogues of such enzymes.

Preferably a pectolytic enzyme useful in the method of the invention is a pectinase enzyme which catalyzes the random cleavage of a-1,4-glycosidic linkages in pectic acid also called polygalacturonic acid by transelimination such as the enzyme class polygalacturonate lyase (EC 4.2.2.2) (PGL) also known as poly(1,4-a-D-galacturonide) lyase also known as pectate lyase. Also preferred is a pectinase enzyme which catalyzes the random hydrolysis of a-1,4-glycosidic linkages in pectic acid such as the enzyme class polygalacturonase (EC 3.2.1.15) (PG) also known as endo-PG. Also preferred is a pectinase enzyme such as polymethylgalcturonate lyase (EC 4.2.2.10) (PMGL), also known as Endo-PMGL, also known as poly(methyoxygalacturonide)lyase also known as pectin lyase which catalyzes the random cleavage of a-1,4-glycosidic linkages of pectin. Other preferred pectinases are galactanases (EC 3.2.1.89), arabinanases (EC 3.2.1.99), pectin esterases (EC 3.1.1.11), and mannanases (EC 3.2.1.78). One example of commercially available pectolytic enzyme product useful in the method of the present invention is PrimaGreen® EcoScour (available from DuPont Company, U.S.A.).

The enzyme preparation useful in the present invention is preferably derived from a microorganism, preferably from a bacterium, an archea or a fungus, especially from a bacterium such as a bacterium belonging to *Bacillus*, preferably to an alkalophilic *Bacillus* strain which may be selected from the group consisting of the species *Bacillus licheniformis* and highly related *Bacillus* species in which all species are at least 90% homologous to *Bacillus licheniformis* based on aligned 16S rDNA sequences. Specific examples of such species are the species *Bacillus licheniformis, Bacillus alcalophilus, Bacillus pseudoalcalophilus*, and *Bacillus clarkii*. A specific and highly preferred example is the species *Bacillus licheniformis*, ATCC 14580 which is described in WO 99/27084. Other useful pectate lyases are derivable from the species *Bacillus agaradhaerens*, especially from the strain deposited as NCIMB 40482; and from the species *Aspergillus aculeatus*, especially the strain and the enzyme disclosed in WO 94/14952 and WO 94/21786 which are hereby incorporated by reference in their entirety; and from the species *Bacillus subtilis, Bacillus stearothermophilus, Bacillus pumilus, Bacillus cohnii, Bacillus pseudoalcalophilus, Erwinia* sp. 9482, especially the strain FERM BP-5994, and *Paenibacillus polymyxa*.

The pectolytic enzyme may be a component occurring in an enzyme system produced by a given microorganism, such an enzyme system mostly comprising several different pectolytic enzyme components including those identified above.

Alternatively, the pectolytic enzyme may be a single component, i.e. a component essentially free of other pectinase enzymes which may occur in an enzyme system produced by a given microorganism, the single component typically being a recombinant component, i.e. produced by cloning of a DNA sequence encoding the single component and subsequent cell transformed with the DNA sequence and expressed in a host. Such useful recombinant enzymes, especially pectate lyases, pectin lyases and polygalacturonases are described in detail in e.g. applicants co-pending International patent applications nos. PCT/DK98/00514 and PCT/DK98/00515 which are hereby incorporated by reference in their entirety including the sequence listings. The host is preferably a heterologous host, but the host may under certain conditions also be the homologous host.

The pectolytic enzyme to be used in the method of the present invention may be obtained or derived from a microorganism by use of any suitable technique. For instance, a pectinase preparation may be obtained by fermentation of a microorganism and subsequent isolation of a pectinase containing preparation from the fermented broth or microorganism by methods known in the art, but more preferably by use of recombinant DNA techniques as known in the art. Such method normally comprises cultivation of a host cell transformed with a recombinant DNA vector capable of expressing and carrying a DNA sequence encoding the pectinase in question, in a culture medium under conditions permitting the expression of the enzyme and recovering the enzyme from the culture. The component comprised by the enzyme composition of the invention may also be produced by conventional techniques such as produced by a given microorganism as a part of an enzyme system.

For purposes of the present invention, the sequence identity between two amino acid sequences is determined using the Needleman-Wunsch algorithm (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends Genet.* 16: 276-277), preferably version 5.0.0 or later. The parameters used are gap open penalty of 10, gap extension penalty of 0.5, and the EBLOSUM62 (EMBOSS version of BLOSUM62) substitution matrix. The output of Needle labeled "longest identity" (obtained using the –nobrief option) is used as the percent identity and is calculated as follows:

(Identical Residues×100)/(Length of Alignment–Total Number of Gaps in Alignment)

For purposes of the present invention, the sequence identity between two deoxyribonucleotide sequences is determined using the Needleman-Wunsch algorithm (Needleman and Wunsch, 1970, supra) as implemented in the Needle program of the EMBOSS package (EMBOSS: The European Molecular Biology Open Software Suite, Rice et al., 2000, supra), preferably version 5.0.0 or later. The parameters used are gap open penalty of 10, gap extension penalty of 0.5, and the EDNAFULL (EMBOSS version of NCBI NUC4.4) substitution matrix. The output of Needle labeled "longest identity" (obtained using the –nobrief option) is used as the percent identity and is calculated as follows:

(Identical Deoxyribonucleotides×100)/(Length of Alignment–Total Number of Gaps in Alignment)

In the present invention, the pectolytic enzyme is preferably pectate lyase, some examples of the pectolytic enzyme are pectate lyases described in WO 2008/039353, preferably the pectate lyase consists of SEQ ID NO: 1 described in WO 2008/039353. Some examples of the pectolytic enzyme are pectate lyases described in WO 99/27084. In some preferable embodiments, the full-length sequence of the pectate lyase is shown in the SEQ ID NO: 4 in WO 99/27084 and is renamed as SEQ ID NO: 1 in the present invention. The mature polypeptide of the SEQ ID NO: 1 of the present invention consists of amino acid 28-341.

In some embodiments of the present invention, the pectolytic enzyme of the present invention have at least 60%, at least 70%, at least 80%, at least 90%, at least 95%, at least 96%, at least 97%, at least 98%, at least 99% or at least 100% identity to the polypeptide or mature polypeptide of SEQ ID NO: 1. In preferable embodiments, the pectolytic enzyme consists of SEQ ID NO:1 or amino acid 28-341 of SEQ ID NO: 1.

In some embodiments of the present invention, the polypeptide sequence of the peroxidase can be variants comprising a substitution, deletion, and/or insertion of one or more (or several) amino acids of the polypeptide or the mature polypeptide of SEQ ID NO: 1 of the present invention, or a homologous sequence thereof. Preferably, amino acid changes (i.e. substitution, deletion, and/or insertion of one or more (or several) amino acids) are of a minor nature, that is conservative amino acid substitutions or insertions that do not significantly affect the folding and/or activity of the protein; small deletions, typically of one to about 30 amino acids; small amino or carboxyl-terminal extensions, such as an amino-terminal methionine residue; a small linker peptide of up to about 20-25 residues; or a small extension that facilitates purification by changing net charge or another function, such as a poly-histidine tract, an antigenic epitope or a binding domain.

Examples of conservative substitutions are within the group of basic amino acids (arginine, lysine and histidine), acidic amino acids (glutamic acid and aspartic acid), polar amino acids (glutamine and asparagine), hydrophobic amino acids (leucine, isoleucine and valine), aromatic amino acids (phenylalanine, tryptophan and tyrosine), and small amino acids (glycine, alanine, serine, threonine and methionine) Amino acid substitutions that do not generally alter specific activity are known in the art and are described, for example, by H. Neurath and R. L. Hill, 1979, *In, The Proteins*, Academic Press, New York. The most commonly occurring exchanges are Ala/Ser, Val/Ile, Asp/Glu, Thr/Ser, Ala/Gly, Ala/Thr, Ser/Asn, Ala/Val, Ser/Gly, Tyr/Phe, Ala/Pro, Lys/Arg, Asp/Asn, Leu/Ile, Leu/Val, Ala/Glu, and Asp/Gly.

Essential amino acids in a parent polypeptide can be identified according to procedures known in the art, such as site-directed mutagenesis or alanine-scanning mutagenesis (Cunningham and Wells, 1989, *Science* 244: 1081-1085). In the latter technique, single alanine mutations are introduced at every residue in the molecule, and the resultant mutant molecules are tested for endoglucanse activity to identify amino acid residues that are critical to the activity of the molecule. See also, Hilton et al., 1996, *J. Biol. Chem.* 271: 4699-4708. The active site of the enzyme or other biological interaction can also be determined by physical analysis of structure, as determined by such techniques as nuclear magnetic resonance, crystallography, electron diffraction, or photoaffinity labeling, in conjunction with mutation of putative contact site amino acids. See, for example, de Vos et al., 1992, *Science* 255: 306-312; Smith et al., 1992, *J. Mol. Biol.* 224: 899-904; Wlodaver et al., 1992, *FEBS Lett.* 309: 59-64. The identities of essential amino acids can also be inferred from analysis of identities with polypeptides that are related to the parent polypeptide.

Single or multiple amino acid substitutions, deletions, and/or insertions can be made and tested using known methods of mutagenesis, recombination, and/or shuffling, followed by a relevant screening procedure, such as those disclosed by Reidhaar-Olson and Sauer, 1988, *Science* 241: 53-57; Bowie and Sauer, 1989, *Proc. Natl. Acad. Sci. USA* 86: 2152-2156; WO 95/17413; or WO 95/22625. Other methods that can be used include error-prone PCR, phage display (e.g., Lowman et al., 1991, *Biochemistry* 30: 10832-10837; U.S. Pat. No. 5,223,409; WO 92/06204), and region-directed mutagenesis (Derbyshire et al., 1986, *Gene* 46: 145; Ner et al., 1988, DNA 7: 127).

Mutagenesis/shuffling methods can be combined with high-throughput, automated screening methods to detect activity of cloned, mutagenized polypeptides expressed by host cells (Ness et al., 1999, *Nature Biotechnology* 17: 893-896). Mutagenized DNA molecules that encode active polypeptides can be recovered from the host cells and rapidly sequenced using standard methods in the art. These methods allow the rapid determination of the importance of individual amino acid residues in a polypeptide.

Preferably, the total number of amino acid substitutions, deletions and/or insertions of the polypeptide or the mature polypeptide of SEQ ID NO: 1 or the present invention is not more than 10, e.g., 1, 2, 3, 4, 5, 6, 7, 8 or 9.

The polypeptide may be hybrid polypeptide in which a portion of one polypeptide is fused at the N-terminus or the C-terminus of a portion of another polypeptide.

The polypeptide may be a fused polypeptide or cleavable fusion polypeptide in which another polypeptide is fused at the N-terminus or the C-terminus of the polypeptide of the present invention. A fused polypeptide is produced by fusing a polynucleotide encoding another polypeptide to a polynucleotide of the present invention. Techniques for producing fusion polypeptides are known in the art, and include ligating the coding sequences encoding the polypeptides so that they are in frame and that expression of the fused polypeptide is under control of the same promoter(s) and terminator. Fusion proteins may also be constructed using intein technology in which fusions are created post-translationally (Cooper et al., 1993, *EMBO J.* 12: 2575-2583; Dawson et al., 1994, *Science* 266: 776-779).

A fusion polypeptide can further comprise a cleavage site between the two polypeptides. Upon secretion of the fusion protein, the site is cleaved releasing the two polypeptides. Examples of cleavage sites include, but are not limited to, the sites disclosed in Martin et al., 2003, *J. Ind. Microbiol. Biotechnol.* 3: 568-576; Svetina et al., 2000, *J. Biotechnol.* 76: 245-251; Rasmussen-Wilson et al., 1997, *Appl. Environ. Microbiol.* 63: 3488-3493; Ward et al., 1995, *Biotechnology* 13: 498-503; and Contreras et al., 1991, *Biotechnology* 9: 378-381; Eaton et al., 1986, *Biochemistry* 25: 505-512; Collins-Racie et al., 1995, *Biotechnology* 13: 982-987; Carter et al., 1989, Proteins: Structure, *Function, and Genetics* 6: 240-248; and Stevens, 2003, Drug Discovery World 4: 35-48.

Additional Enzymes

It will be appreciated that one or more cellulase, peroxidase, perhydrolase, laccase, amylase, lipase, mannanase, amylase, protease, oxidase, catalase or other enzyme mentioned, herein, may be used as additional enzyme in the present methods. Moreover, any number of additional enzymes (or enzyme systems) can be combined with the present compositions and methods without defeating the spirit of the disclosure.

The protease may for example be a metalloprotease (EC 3.4.17 or EC 3.4.24) or a serine protease (EC 3.4.21), preferably an alkaline microbial protease or a trypsin-like protease. Examples of proteases are subtilisins (EC 3.4.21.62), especially those derived from *Bacillus*, e.g., subtilisin Novo, subtilisin Carlsberg, subtilisin 309, subtilisin 147 and subtilisin 168 (described in WO 89/06279). Examples of trypsin-like proteases are trypsin (e.g., of porcine or bovine origin) and the *Fusarium* protease described in WO 89/06270 and WO 94/25583.

The term "cellulase" refers to an enzyme which catalyses the degradation of cellulose to glucose, cellobiose, triose and other cello-oligosaccharides. Cellulase includes those usually identified as, e.g., cellobiohydrolases, endoglucanases, and beta-glucosidases. Examples of commercially available cellulase enzyme products useful in the method of the present invention are: Cellusoft®, Celluclast®, Denimax® Acid, Denimax® Ultra (all available from Novozymes A/S, Bagsvaerd, Denmark); Indiage™, Primafast™ (both from Genencor International Inc., U.S.A.); Powerstone™ (from Iogen, Canada) and Ecostone™, Biotouch™ (both from AB Enzymes, Finland).

A "perhydrolase" is an enzyme capable of catalyzing a perhydrolysis reaction that results in the production of a sufficiently high amount of peracid for use in an oxidative dye decolorization method as described. Generally, the perhydrolase enzyme exhibits a high perhydrolysis to hydrolysis ratio. In some embodiments, the perhydrolase enzyme is a naturally occurring *Mycobacterium smegmatis* perhydrolase enzyme or a variant thereof. This enzyme, its enzymatic properties, its structure, and numerous variants and homologs, thereof, are described in detail in International Patent Application Publications WO 05/056782A and WO 08/063400A and U.S. Patent Application Publications US2008145353 and US2007167344, which are incorporated by reference.

A "laccase" is a multi-copper containing oxidase (EC 1.10.3.2) that catalyzes the oxidation of phenols, polyphenols, and anilines by single-electron abstraction, with the concomitant reduction of oxygen to water in a four-electron transfer process. Examples of commercially available laccase enzyme products useful in the method of the present invention are: EcoFade LT100 (available Genencor International Inc., U.S.A.) and Novoprime Base 268 (available Novozymes A/S).

Suitable amylases include α-amylases and β-amylases, preferably of bacterial or fungal origin. Chemically modified or protein engineered mutants are included. Amylases include α-amylases derived from *Bacillus*, e.g., a special strain of *Bacillus licheniformis*, described in more detail in GB 1,296,839, and variants thereof.

Examples of amylase variants are described in WO 94/02597, WO 94/18314, WO 96/23873, and WO 97/43424, especially the variants with substitutions in one or more of the following positions: 15, 23, 105, 106, 124, 128, 133, 154, 156, 181, 188, 190, 197, 202, 208, 209, 243, 264, 304, 305, 391, 408, and 444.

Commercially available amylases are Stainzyme; Stainzyme Plus; Duramyl™, Termamyl™, Termamyl Ultra; Natalase, Fungamyl™ and BAN™ (Novozymes A/S), Rapidase™ and Purastar™ (DuPont Inc.).

Suitable peroxidases/oxidases include those of plant, bacterial or fungal origin. Chemically modified or protein engineered mutants are included. Examples of useful peroxidases include peroxidases from *Coprinus*, e.g., from *C. cinereus*, and variants thereof as those described in WO 93/24618, WO 95/10602, and WO 98/15257. Commercially available peroxidases include Guardzyme™ (Novozymes A/S).

Textile

As used herein, the term "textile" refers to fibers, yarns, fabrics, garments, and non-wovens. The term encompasses textiles made from natural, synthetic (e.g., manufactured), and various natural and synthetic blends. Textiles may be unprocessed or processed fibers, yarns, woven or knit fabrics, non-wovens, and garments and may be made using a variety of materials, some of which are mentioned, herein.

The process of the invention is most beneficially applied to cellulose-containing fabrics, such as cotton, viscose, rayon, ramie, linen, Tencel, or mixtures thereof, or mixtures of any of these fibres, or mixtures of any of these fibres together with synthetic fibres such as mixtures of cotton and spandex (stretch-denim).

In particular, the fabric is dyed fabric, preferably is denim. The denim fabric may be dyed with vat dyes such as indigo, or indigo-related dyes such as thioindigo, or a sulfur dye, or a direct dye, or a reactive dye, or a naphthol. Preferably the dyeing of the denim yarn, fabric or garment is a ring-dyeing. A preferred embodiment of the invention is ring-dyeing of the yarn with a vat dye such as indigo, or an indigo-related dye such as thioindigo, or a sulfur dye, or a direct dye, or a reactive dye, or a naphthol. The yarn may also be dyed with more than one dye, e.g., first with a sulphur dye and then with a vat dye, or vice versa. The indigo may be derived from the indigo plant material, or synthetic, or the biosynthetic indigo available from Genencor International.

In a most preferred embodiment of the process of the invention, the fabric is indigo-dyed denim, including clothing items manufactured therefrom.

Textile Manufacturing Process

The processing of a fabric, such as of a cellulosic material, into material ready for garment manufacture involves several steps: spinning of the fiber into a yarn; construction of woven or knit fabric from the yarn; and subsequent preparation processes, dyeing/printing and finishing operations. Preparation processes are necessary for removing natural and man-induced impurities from fibers and for improving their aesthetic appearance and processability prior to for instance dyeing/printing and finishing. Common preparation processes comprise desizing (for woven goods), scouring, and bleaching, which produce a fabric suitable for dyeing or finishing.

Woven fabric is constructed by weaving "filling" or "weft" yarns between warp yarns stretched in the longitudinal direction on the loom. The warp yarns must be sized before weaving in order to lubricate and protect them from abrasion at the high speed insertion of the filling yarns during weaving. Common size agents are starches (or starch derivatives and modified starches), poly(vinyl alcohol), carboxyl methyl cellulose (i.e. CMC) where starches are dominant. Paraffin, acrylic binders and variety of lubricants are often included in the size mix. The filling yarn can be woven through the warp yarns in a "over one—under the next" fashion (plain weave) or by "over one—under two" (twill) or any other myriad of permutations. Generally, dresses, shirts, pants, sheeting's, towels, draperies, etc. are produced from woven fabric. After the fabric is made, size on the fabric must be removed again (i.e. desizing).

Knitting is forming a fabric by joining together interlocking loops of yarn. As opposed to weaving, which is constructed from two types of yarn and has many "ends", knitted fabric is produced from a single continuous strand of yarn. As with weaving, there are many different ways to loop yarn together and the final fabric properties are dependent both upon the yarn and the type of knit. Underwear, sweaters, socks, sport shirts, sweat shirts, etc. are derived from knit fabrics.

Desizing

Desizing is the degradation and/or removal of sizing compounds from warp yarns in a woven fabric. Starch is usually removed by an enzymatic desizing procedure. In addition, oxidative desizing and chemical desizing with acids or bases are sometimes used.

In some embodiments, the desizing enzyme is an amylolytic enzyme, such as an alpha-amylase, a beta-amylase, a mannanases, a glucoamylases, or a combination thereof.

Suitable alpha and beta-amylases include those of bacterial or fungal origin, as well as chemically or genetically modified mutants and variants of such amylases. Suitable alpha-amylases include alpha-amylases obtainable from *Bacillus* species. Suitable commercial amylases include but are not limited to OPTISIZE® NEXT, OPTISIZE® FLEX and OPTISIZE® COOL (all from Genencor International Inc.), and DURAMYL™, ERMAMYL™, FUNGAMYL™ TERMAMYL™, AUQAZYME™ and BAN™ (all available from Novozymes A/S, Bagsvaerd, Denmark).

Other suitable amylolytic enzymes include the CGTases (cyclodextrin glucanotransferases, EC 2.4.1.19), e.g., those obtained from species of *Bacillus, Thermoanaerobactor* or *Thermoanaero*-bacterium.

Scouring

Scouring is used to remove impurities from the fibers, to swell the fibers and to remove seed coat. It is one of the most critical steps. The main purposes of scouring is to a) uniformly clean the fabric, b) soften the motes and other trashes, c) improve fabric absorbency, d) saponify and solubilize fats, oils, and waxes, and e) minimize immature cotton. Sodium hydroxide scouring at about boiling temperature is the accepted treatment for 100% cotton, while calcium hydroxide and sodium carbonate are less frequently used. Synthetic fibers are scoured at much milder conditions. Surfactant and chelating agents are essential for alkaline scouring Enzymatic scouring has been introduced, wherein cellulase, hemicellulase, pectinase, lipase, and protease are all reported to have scouring effects.

Bleaching

Bleaching is the destruction of pigmented color and/or colored impurities as well as seed coat fragment removal. Bleaching is performed by the use of oxidizing or reducing chemistry. Oxidizing agents can be further subdivided into those that employ or generate: a) hypochlorite ($OCl^-$), b) chloride dioxide ($ClO_2$), c) permanganate ($MnO_4$_), d) ozone, and hydroperoxide species ($OOH^-$ and/or OOH). Reducing agents are typical sulfur dioxide, hydrosulfite salts, etc. Enzymatic bleaching using glucose oxidase or peroxidase (for example, see WO 2013/040991) has been reported. Traditionally, hydrogen peroxide is used in this process.

Printing and Dyeing

Printing and dyeing of textiles is carried out by applying dyes to the textile by any appropriate method for binding the dyestuff to the fibres in the textiles. The dyeing of textiles is for example carried out by passing the fabric through a concentrated solution of dye, followed by storage of the wet fabric in a vapour tight enclosure to permit time for diffusion and reaction of the dye with the fabric substrate prior to rinsing off un-reacted dye. Alternatively, the dye may be fixed by subsequent steaming of the textile prior to rinsing. The dyes include synthetic and natural dyes. Typical dyes are those with anionic functional groups (e.g. acid dyes, direct dyes, Mordant dyes and reactive dyes), those with cationic groups (e.g. basic dyes), those requiring chemical reaction before application (e.g. vat dyes, sulphur dyes and azoic dyes), disperse dyes and solvent dyes.

Excess soluble dyestuff not bound to the fibres must be removed after dyeing to ensure fastness of the dyed textiles and to prevent unwanted dye transfer during laundering of the textiles by the consumer. Generally, a large amount of water is required for complete removal of excess dye. In a conventional process, the printed or dyed textile is first rinsed with cold water, then washed at high temperature with the addition of a suitable additive to decrease back-staining, like poly(vinylpyrrolidone) (PVP).

An enzymatic process for removal of excess dye from dyed fabric with a rinse liquor comprising at least one peroxidise, an oxidase agent and at least one mediator, such as liquor comprising a peroxidase, hydrogen peroxidise and a mediator like 1-hydroxy-benzotriazole is disclosed in WO99/34054.

Biopolishing

As used herein, the term "biopolishing", "depilling" and "anti-pilling" are interchangeable.

Most cotton fabrics and cotton blend fabrics have a handle appearance that is rather hard and stiff without the application of finishing components. The fabric surface also is not smooth because small fuzzy microfibrils protrude from it. In addition, after a relatively short period of wear, pilling appears on the fabric surface thereby giving it an unappealing, worn look.

Biopolishing is a method to treat cellulosic fabrics during their manufacture by enzymes such as cellulases, which improves fabric quality with respect to "reduced pilling formation". The most important effects of biopolishing can be characterised by less fuzz and pilling, increased gloss/luster, improved fabric handle, increased durable softness and/or improved water absorbency. Biopolishing usually takes place in the wet processing of the manufacture of knitted and woven fabrics or garments. Wet processing comprises such steps as e.g., desizing, scouring, bleaching, washing, dying/printing and finishing. Biopolishing could be performed as a separate step after any of the wetting steps or in combination with any of those wetting steps.

Manufacturing of Denim Fabric

Some dyed fabric such as denim fabric, requires that the yarns are dyed before weaving. For denim fabric, the warp yarns are dyed for example with indigo, and sized, before weaving. Preferably the dyeing of the denim yarn is a ring-dyeing. A preferred embodiment of the invention is ring-dyeing of the yarn with a vat dye such as indigo, or an indigo-related dye such as thioindigo, or a sulfur dye, or a direct dye, or a reactive dye, or a naphthol. The yarn may also be dyed with more than one dye, e.g., first with a sulphur dye and then with a vat dye, or vice versa.

Preferably, the yarns undergo scouring and/or bleaching before they are dyed, in order to achieve higher quality of denim fabric. In general, after woven into dyed fabric, such as denim, the dyed fabric or garment proceeds to a desizing stage, preferably followed by an abrasion step and/or a conventional color modification step.

The desizing process as used herein is the same process as mentioned above in the text.

After desizing, the dyed fabric undergoes an abrasion step. The abrasion step can be performed with enzymes or pumice stones or both. As used herein, the term "abrasion", "stone washing" and "biostoning" are interchangeable, which means agitating the denim in an aqueous medium containing a mechanical abrasion agent such as pumice, an abrading cellulase or a combination of these, to provide a "stone-washed" look (i.e. a localized variation of colour density in the denim surface). In all cases, mechanical action is needed to remove the dye, and the treatment is usually carried out in washing machines, like drum washers, belly washers. As a result of uneven dye removal there are contrasts between dyed areas and areas from which dye has been removed, this appears as a localized variation of colour density. Treatment with cellulase can completely replace treatment with pumice stones. However, cellulase treatment can also be combined with pumice stone treatment, when it is desired to produce a heavily abraded finish.

Preferably, the abrasion is followed by a conventional color modification step. As used herein, the terms "color modification" or "color adjustment" are used without distinction to refer to any change to the color of a textile resulting from the destruction, modification, or removal of a dyestuff associated with the textile. Without being limited to a theory, it is proposed that color modification results from the modification of chromaphores associated with a textile material, thereby changing its visual appearance. The chromophores may be naturally-associated with the material used to manufacture a textile (e.g., the white color of cotton) or associated with special finishes, such as dying or printing. Color modification encompasses chemical modification to a chromophore as well as chemical modification to the material to which a chromophore is attached.

Examples of conventional color modification include but are not limited to, bleaching, reduction of redeposition/backstaining, fading, imparting a grey cast, altering hue, saturation, or luminescence, and the like. The amount and type of color modification can be determined by comparing the color of a textile following enzymatic treatment with a perhydrolase enzyme (i.e., residual color) to the color of the textile prior to enzymatic treatment (i.e., original color) using known spectrophotometric or visual inspection methods.

The Process of the Invention

The invention provides a method for treating dyed textile, comprising contacting dyed textile with a pectolytic enzyme.

In some embodiments, the dyed textile is dyed fabric or dyed garment. In some embodiments, the dyed fabric is denim fabric or dyed non-denim fabric.

In some embodiments, the color of the dyed textile is modified after the said treating process. In some preferred embodiments, the color modification is preferably selected from strengthening of color, lightening of color, change of color and change in color cast, and more preferably, the color modification is the increase of blue cast.

In some embodiments, the method is applied before, during or after any stages of fabric washing stage, such as desizing stage, abrasion stage and conventional color modification stage, it also can be applied in any combined washing stages.

In some embodiments, the method is not applied during the abrasion stage when the dyed fabric is a denim fabric.

In some embodiments, the method is applied before, during or after desizing stage, preferably the dyed textile is dyed garment or woven dyed fabric, more preferably, said woven dyed fabric is denim fabric. In some preferred embodiments, the desizing stage is followed by abrasion stage.

In some embodiments, the method is applied before, during or after abrasion stage, preferably the dyed textile is dyed garment or denim fabric. In some preferred embodiments, the abrasion stage is followed by conventional color modification stage.

In some embodiments, the method is applied before, during or after conventional color modification stage, preferably the dyed textile is dyed garment or dyed denim fabric. In some preferred embodiments, the conventional color modification stage is bleaching stage.

In some preferred embodiments, the process of the invention is applied in a combi-process, i.e. the process is applied in a combined desizing, abrasion and/or conventional color modification process.

In some embodiments, the textile is indigo-dyed, sulphur-dyed or reactive-dyed.

In some embodiments, the pectolytic enzyme is applied alone or together with an additional enzyme. The term "an additional enzyme" means at least one additional enzyme, e.g. one, two, three, four, five, six, seven, eight, nine, ten or even more additional enzymes.

The term "applied together with" (or "used together with") means that the additional enzyme may be applied in the same, or in another step of the process of the invention. The other process step may be upstream or downstream in the textile manufacturing process, as compared to the step in which the textile is treated with a peroxidase.

In some embodiments, the process can be continuous process, pad-batch, exhaust process and washing process.

In particular embodiments the additional enzyme is an enzyme which has protease, lipase, xylanase, cutinase, oxidoreductase, cellulase, endoglucanase, amylase, mannanase, perhydrolase, peroxidase, and/or laccase.

In some embodiments, the pH of the aqueous medium is from 3 to 11, preferably from 5.5 to 9.5, preferably from 6 to 9, more preferably from 6.5 to 8.5.

In some embodiments, the temperature of the aqueous medium is 20-85° C., preferably 35-80° C., preferably 40-70° C., more preferably 50-60° C.

The efficient amount of pectolytic enzyme to be used according to the method of the present invention depends on many factors, in some embodiments, the concentration of the pectolytic enzyme in the aqueous medium may be from about 0.01 to about 10000 microgram enzyme protein per g of fabric, preferably 0.1-1000 microgram of enzyme protein per g of fabric, more preferably 1-100 microgram of enzyme protein per g of fabric.

Determination of Pectolytic Enzyme Activity

1. Pectolytic Enzyme Assay:

For this assay, a 0.1% sodium polygalacturonate (Sigma P-1879) solution is prepared in 0.1 M glycine buffer, pH 10. 4 ml of this solution are preincubated for 5 min at 40° C. Then, 250 μl of the enzyme (or enzyme dilution) are added, after which the reaction is mixed for 10 sec on a mixer at the highest speed and incubated for 20 min at 40° C. or at another temperature, after which the absorbance at 235 nm is measured using a 0.5 ml cuvette with a 1 cm light path on a HP diode array spectrophotometer in a temperature controlled cuvette holder with continuous measurement of the absorbance at 235 nm. For steady state a linear increase for at least 200 sec was used for calculation of the rate.

For calculation of the catalytic rate, an increase of 5.2 $A_{235}$ per min corresponds to formation of 1 μmol of unsaturated product (Nasuna et al., *J. Biol. Chem.* 241:5298-5306, 1966; and Baffling et al., *Microbiology,* 141:873-881, 1995).

2. Agar Assay:

Pectate lyase activity can be measured by applying a test solution to 4 mm holes punched out in agar plates (such as, for example, LB agar), containing 0.7% w/v sodium polygalacturonate (Sigma P 1879). The plates are then incubated for 6 hours at a particular temperature (such as, e.g., 75° C.). The plates are then soaked in either (i) 1M $CaCl_2$ for 0.5 h or (ii) 1% mixed alkyl trimethylammonium Br (MTAB, Sigma M-7635) for 1 h. Both of these procedures cause the precipitation of polygalacturonate within the agar. Pectate lyase activity can be detected by the appearance of clear zones within a background of precipitated polygalacturonate. Sensitivity of the assay is calibrated using dilutions of a standard preparation of pectate lyase.

EXAMPLES

Materials & Methods

Pectate lyase A, a *Bacillus licheniformis* pectate lyase described in WO99/27084, the full-length sequence of the enzyme is shown as SEQ ID NO: 1 of the present invention Pectate lyase B, PrimaGreen® EcoScour, commercially available from DuPont Company, USA Denilite® Cold, an enzyme product containing peroxidase, mediator and a source of hydrogen peroxide, commercially available from Novozymes A/S Denimax® Core 1380 S, an enzyme product containing cellulase and alpha-amylase, commercially available from Novozymes A/S Suhong Desizyme conc, an enzyme product containing amylase, commercially available from Novozymes A/S PrimaGreen® EcoFade, an enzyme product containing laccase and syringonitrile, commercially available from DuPont Company, USA Colour Measurement The color of the fabric samples were determined by measuring the reflectance with pre-calibrated DataColor SF450X, alternatively an equivalent apparatus can be used. Four readings were taken for each sample, and the average of the readings were used. The color was evaluated with the index CIE L*, a* and b*of the sample.

L* indicates the color change in white/black on a scale from 0 to 100, and a decrease in L* means an increase in black colour (decrease in white colour) and an increase in L* means an increase in white colour (decrease in black colour). Delta L* unit=L* of the swatch after treatment−L* of the swatch before treatment. The larger the Delta L* unit is, the brighter and/or whiter the fabric is, the more negative the Delta L* unit is, the darker and/or deeper color the fabric is. (e.g. a Delta L* unit of 2 means the fabric has been bleached, while a Delta L* unit of −2 means the color of the fabric has been darkened.).

a* indicates the color change in green/red, and a decrease in a* means an increase in green colour (decrease in red colour), and an increase in a* means an increase in red colour (decrease in green colour). Delta a* units=a* of the swatch after treatment−a* of the swatch before treatment. The larger the Delta a* unit is, the redder the color is. (e.g. a Delta b* unit of 3 has higher bleaching level than Delta b* unit of 1). The more negative the Delta a* unit is, the greener the color is.

b* indicates the color change in blue/yellow, and a decrease in b* means an increase in blue colour (decrease in yellow colour), and an increase in b* means an increase in yellow colour (decrease in blue colour). Delta b* units=b* of the swatch after treatment−b* of the swatch before treatment. The larger the Delta b* unit is, the yellower the color is. The more negative the Delta b* unit is, the bluer the color is.

Example 1

Color Modification with Pectate Lyase on Denim Fabric from Different Washing Stages Denim fabrics from different washing stages were subjected to color modification trials with pectate lyase. Fabric details were described below:

| No. | Dye on denim fabric | Previous process |
|---|---|---|
| 1 | Indigo 100% | Desizing with water, 70° C., 15 min |
| 2 | Indigo 100% | Desizing + Abrasion with Denimax ® Core 1380 S, 50° C., 85 min |

The trials were conducted in Wascator (Electrolux, Switzerland). For each trial, four pieces of large denim tubes weighed up around 1 kg were loaded together. The dosage of pectate lyase A was 1.6 mg enzyme protein/g denim. The trials conditions were described as below:

| | |
|---|---|
| Main wash | 55° C., 20 min; pectate lyase A 1.6 mg enzyme protein/g denim; liquid to fabric ratio 10:1 (w/w); pH 7 with 50 mM $Na_2HPO_4/NaH_2PO_4$ phosphate buffer. |
| Drain | |
| Rinse | 25° C., 5 min; liquid to fabric ratio 10:1 (w/w) |
| Drain | |
| Rinse | 25° C., 5 min; liquid to fabric ratio 15:1 (w/w) |
| Drain | |
| Extracted and Tumble-dried | |

Trials results were shown in Table 1. Denim fabrics treated with pectate lyase has shown decrease in b* value, indicating the denim fabrics were all given a bluer cast by the pectate lyase treatment.

TABLE 1

Results of color modification trial.

| | Color change | |
|---|---|---|
| Fabric No. | Delta L* | Delta b* |
| 1 | 0.04 | −0.57 |
| 2 | 1.49 | −0.84 |

Note:
average of twice samples for each dosage.

Example 2

Color Modification with Pectate Lyase During Desizing

The desizing process of denim was carried out with dip-pad-incubate-washing steps: Raw denim fabric dyed by indigo was cut into 20 cm*20 cm swatches, and then went to the process. The dip procedure was performed in a 1 L flask with 800 mL treating solution. The pad procedure was performed with a padder (Mathis Lab Padder, manufactured by Werner Mathis AG), when the wet fabric swatch goes between the pressured two rollers of the padder, it will get a uniform pick-up. The incubate procedure was done in a water bath kettle (Heto HTM200). The washing procedure included 6 repeated steps of dip-pad the fabric swatch with water. The conditions for the whole process were described in below table.

| | |
|---|---|
| Dip | Dip fabric swatches into the Solution 1 and 2 respectively at room temperature for 1 min:<br>Solution 1: Suhong Disizyme conc. 1.7 g/L, pH 7 with 50 mM $Na_2HPO_4/NaH_2PO_4$ phosphate buffer.<br>Solution 2: Suhong Disizyme conc. (1.7 g/L) + pectate lyase A (10.8 mg enzyme protein/L); pH 7 with 50 mM $Na_2HPO_4/NaH_2PO_4$ phosphate buffer. |
| Pad | Pad fabric swatches with a pick-up of 100%. |
| Incubate | Put each fabric swatch into one plastic bag and then incubate in the water bath kettle at 50° C. for 3 min. |
| Wash | Repeat the following step for 6 times: dip fabric swatches in 60° C. water for 10 seconds, then pick out the swatches and pad with 100% pick-up. |
| Dry | Tumble dry at 100° C. for 40 min. |

Table 2 showed that using Pectate lyase during the denim desizing stage could increase the bluish cast of the treated fabric, as indicated by a more negative b* value.

TABLE 2

Result of the desizing process

| | Fabric color | |
|---|---|---|
| Solution No. | Average L* | Average b* |
| 1 | 17.65 | −5.3 |
| 2 | 17.54 | −5.72 |

Note:
for each condition average of 4 duplicate samples were measured.

Example 3

Color Modification with Pectate Lyases on Denim Fabrics with Different Dye Composition and Bleached with Different Methods The color modification trials were conducted in wascator (Electrolux, Switzerland). Denim fabrics with different dye composition and previously bleached with different methods were subjected to color modification trials with two pectate lyases. Fabric details were as described below:

| Fabric No. | Dye on denim fabric | Bleaching method |
|---|---|---|
| 1 | Indigo 100% | Denilite Cold, 0.5 g/L, pH 5, 30° C., 20 min |
| 2 | Indigo 100% | PrimaGreen ® EcoFade, 1.25 g/L, 30° C., 20 min |
| 3 | Indigo 100% | NaClO (10%), 12 g/L, 40° C., 20 min |
| 4 | Indigo 100% | $KMnO_4$ (3%), 1.3 g/L, 30° C., 20 min |
| 5 | Indigo bottoming, sulphur topping | Denilite Cold, 0.5 g/L, pH 5, 30° C., 20 min |
| 6 | Indigo bottoming, sulphur topping | PrimaGreen ® EcoFade, 1.25 g/L, 30° C., 20 min |
| 7 | Indigo bottoming, sulphur topping | NaClO (10%), 12 g/L, 40° C., 20 min |
| 8 | Indigo bottoming, sulphur topping | $KMnO_4$ (3%), 1.3 g/L, 30° C., 20 min |

The two pectate lyases were Pectate lyase A and Pectate lyase B. Treatment at the same condition without pectate lyase was done as a blank reference. Three trials were run in the Wascator, the dosages of the enzymes were as below described:

| Trial No. | Process | Pectate lyase A, mg enzyme protein/L | Pectate lyase B, g/L |
|---|---|---|---|
| a | Blank | 0 | 0 |
| b | Pectate lyase A | 9.02 | 0 |
| c | Pectate lyase B | 0 | 0.5 |

For each trial, 1 kg of denim legs (15 cm*20 cm) containing 2 pieces of all the 8 types of denim fabric were loaded into Wascator and the washing program ran as below:

| | |
|---|---|
| Main wash | 55° C., 20 min; with or without Pectate Lyase according to Trial plan a, b, and c; liquid to fabric ratio 10:1 (w/w); pH 7 with 50 mM $Na_2HPO_4/NaH_2PO_4$ phosphate buffer. |
| Drain | |
| Rinse | 25° C., 5 min; liquid to fabric ratio 10:1 (w/w) |
| Drain | |
| Rinse | 25° C., 5 min; liquid to fabric ratio 15:1 (w/w) |
| Drain | |
| Extracted and Tumble-dried | 100° C., 40 min |

Table 3 showed that after pectate lyase treatment, the blue color of the fabric was increased, as indicated with the more negative b* values.

TABLE 3

Result of the color modification with Pectate lyase A and Pectate lyase B

| Fabric No. | Process | Delta L* | Delta a* | Delta b* |
|---|---|---|---|---|
| 1 | Blank | 0.3 | 0.25 | 0.11 |
| | Pectate lyase A | −0.19 | 0.2 | −0.21 |
| | Pectate lyase B | −0.01 | 0.11 | −0.15 |
| 2 | Blank | −0.78 | 0.33 | −1.56 |
| | Pectate lyase A | −0.84 | 0.23 | −1.9 |
| | Pectate lyase B | −1.31 | 0.18 | −2.06 |
| 3 | Blank | 1.68 | 0.2 | −0.6 |
| | Pectate lyase A | 1.1 | 0.31 | −0.91 |
| | Pectate lyase B | −0.32 | 0.39 | −1.25 |
| 4 | Blank | −1.1 | 0.48 | −0.75 |
| | Pectate lyase A | −0.28 | 0.35 | −1.22 |
| | Pectate lyase B | −0.38 | 0.38 | −1.1 |
| 5 | Blank | 0.01 | 0.09 | −0.43 |
| | Pectate lyase A | 0.31 | 0.05 | −0.95 |
| | Pectate lyase B | 0.46 | −0.03 | −0.89 |
| 6 | Blank | −0.89 | −0.82 | −0.36 |
| | Pectate lyase A | −0.14 | −0.15 | −0.45 |
| | Pectate lyase B | 0.34 | −0.11 | −0.58 |
| 7 | Blank | 0.13 | 0.26 | −0.72 |
| | Pectate lyase A | −0.72 | 0.43 | −1.13 |
| | Pectate lyase B | −0.64 | 0.35 | −0.95 |
| 8 | Blank | 0.49 | 0.18 | −0.26 |
| | Pectate lyase A | 0.11 | 0.15 | −1.16 |
| | Pectate lyase B | 0.24 | 0.13 | −0.94 |

Note:
each condition, average of 4 duplicate samples were measured.

SEQUENCE LISTING

```
<160> NUMBER OF SEQ ID NOS: 1

<210> SEQ ID NO 1
<211> LENGTH: 341
<212> TYPE: PRT
<213> ORGANISM: Bacillus licheniformis
<220> FEATURE:
<221> NAME/KEY: SIGNAL
<222> LOCATION: (1)..(27)

<400> SEQUENCE: 1

Met Lys Lys Leu Ile Ser Ile Ile Phe Ile Phe Val Leu Gly Val Val
1               5                   10                  15

Gly Ser Leu Thr Ala Ala Val Ser Ala Glu Ala Ala Ser Ala Leu Asn
            20                  25                  30
```

-continued

```
Ser Gly Lys Val Asn Pro Leu Ala Asp Phe Ser Leu Lys Gly Phe Ala
        35                  40                  45

Ala Leu Asn Gly Gly Thr Thr Gly Gly Glu Gly Gly Gln Thr Val Thr
    50                  55                  60

Val Thr Thr Gly Asp Gln Leu Ile Ala Ala Leu Lys Asn Lys Asn Ala
65                  70                  75                  80

Asn Thr Pro Leu Lys Ile Tyr Val Asn Gly Thr Ile Thr Thr Ser Asn
                85                  90                  95

Thr Ser Ala Ser Lys Ile Asp Val Lys Asp Val Ser Asn Val Ser Ile
            100                 105                 110

Val Gly Ser Gly Thr Lys Gly Glu Leu Lys Gly Ile Gly Ile Lys Ile
        115                 120                 125

Trp Arg Ala Asn Asn Ile Ile Ile Arg Asn Leu Lys Ile His Glu Val
    130                 135                 140

Ala Ser Gly Asp Lys Asp Ala Ile Gly Ile Glu Gly Pro Ser Lys Asn
145                 150                 155                 160

Ile Trp Val Asp His Asn Glu Leu Tyr His Ser Leu Asn Val Asp Lys
                165                 170                 175

Asp Tyr Tyr Asp Gly Leu Phe Asp Val Lys Arg Asp Ala Glu Tyr Ile
            180                 185                 190

Thr Phe Ser Trp Asn Tyr Val His Asp Gly Trp Lys Ser Met Leu Met
        195                 200                 205

Gly Ser Ser Asp Ser Asp Asn Tyr Asn Arg Thr Ile Thr Phe His His
    210                 215                 220

Asn Trp Phe Glu Asn Leu Asn Ser Arg Val Pro Ser Phe Arg Phe Gly
225                 230                 235                 240

Glu Gly His Ile Tyr Asn Asn Tyr Phe Asn Lys Ile Ile Asp Ser Gly
                245                 250                 255

Ile Asn Ser Arg Met Gly Ala Arg Ile Arg Ile Glu Asn Asn Leu Phe
            260                 265                 270

Glu Asn Ala Lys Asp Pro Ile Val Ser Trp Tyr Ser Ser Ser Pro Gly
        275                 280                 285

Tyr Trp His Val Ser Asn Asn Lys Phe Val Asn Ser Arg Gly Ser Met
    290                 295                 300

Pro Thr Thr Ser Thr Thr Thr Tyr Asn Pro Pro Tyr Ser Tyr Ser Leu
305                 310                 315                 320

Asp Asn Val Asp Asn Val Lys Ser Ile Val Lys Gln Asn Ala Gly Val
                325                 330                 335

Gly Lys Ile Asn Pro
            340
```

The invention claimed is:

1. A method for modifying the color of a dyed textile, the method comprising contacting the dyed textile with a pectolytic enzyme composition, wherein the dyed textile is a dyed denim fabric or dyed denim garment, wherein the composition does not comprise a cellulase enzyme, and wherein the color modification is the increase of blue cast.

2. The method of claim 1, wherein the dyed textile is indigo-dyed, sulphur-dyed or reactive-dyed.

3. The method of claim 1, wherein the dyed textile is subjected to a desizing step, and wherein the pectolytic enzyme composition is applied after the desizing step.

4. The method of claim 1, wherein the dyed textile is subjected to an abrasion step, and wherein the pectolytic enzyme composition is applied after the abrasion step.

5. The method of claim 1, wherein the dyed textile is subjected to a conventional color modification step, and wherein the pectolytic enzyme composition is applied after the conventional color modification step.

6. The method of claim 5, wherein the conventional color modification is bleaching.

7. The method of claim 1, wherein the pectolytic enzyme is selected from the group consisting of pectin lyases (EC 4.2.2.10), galactanases (EC 3.2.1.89), arabinanases (EC 3.2.1.99), pectin esterases (EC 3.1.1.11), mannanases (EC 3.2.1.78), polygalacturonases (EC 3.2.1.15) and pectate lyases (EC 4.2.2.2).

8. The method of claim 1, wherein the pectolytic enzyme has at least 80% sequence identity to amino acids 28-341 of SEQ ID NO: 1.

9. The method of claim 1, wherein the pectolytic enzyme consists of SEQ ID NO: 1 or amino acid 28-341 of SEQ ID NO: 1.

10. The method of claim 1, wherein the pectolytic enzyme has at least 90% sequence identity to amino acids 28-341 of SEQ ID NO: 1.

11. The method of claim 1, wherein the pectolytic enzyme has at least 95% sequence identity to amino acids 28-341 of SEQ ID NO: 1.

12. The method of claim 1, wherein the pectolytic enzyme has at least 98% sequence identity to amino acids 28-341 of SEQ ID NO: 1.

* * * * *